US009700894B2

(12) United States Patent
Fuller et al.

(10) Patent No.: US 9,700,894 B2
(45) Date of Patent: Jul. 11, 2017

(54) DEVICE AND METHOD FOR TRANSPORT AND STORAGE

(71) Applicant: ALSTOM Technology Ltd, Baden (CH)

(72) Inventors: Mark Andrew Fuller, Canton, CT (US); Allen Reber, Harrisburg, PA (US); Michael Webster, Hilton, NY (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 794 days.

(21) Appl. No.: 14/038,095

(22) Filed: Sep. 26, 2013

(65) Prior Publication Data

US 2015/0082753 A1 Mar. 26, 2015

(51) Int. Cl.
*B02C 23/00* (2006.01)
*B65D 6/08* (2006.01)
(Continued)

(52) U.S. Cl.
CPC ..... *B02C 23/00* (2013.01); *B02C 15/00* (2013.01); *B65D 19/44* (2013.01); *B65D 85/68* (2013.01); *B65D 2519/00024* (2013.01); *B65D 2519/00059* (2013.01); *B65D 2519/0081* (2013.01); *B65D 2519/00129* (2013.01); *B65D 2519/00164* (2013.01); *B65D 2519/00233* (2013.01); *B65D 2519/00273* (2013.01); *B65D 2519/00293* (2013.01); *B65D 2519/00323* (2013.01); *B65D 2519/00333* (2013.01); *B65D 2519/00452* (2013.01); *B65D 2519/00502* (2013.01);
(Continued)

(58) Field of Classification Search
CPC ..... B65D 7/14; B65D 19/44; B65D 85/68; B65D 2585/6897; B65D 2519/00024; B65D 2519/00164; B65D 2519/00532; B65D 2519/00786; B65D 2519/0081; B65D 2519/00059; B65D 2519/00129; B65D 2519/00233; B65D 2519/00273; B65D 2519/00293; B65D 2519/00323; B65D 2519/00333; B65D 2519/00452; B65D 2519/00502; B65D 2519/00616; B65D 2519/00666; B65D 2519/00701; B02C 15/00; B02C 23/00
USPC ..... 53/473; 206/349; 108/55.3, 55.1, 51.11
See application file for complete search history.

(56) References Cited

U.S. PATENT DOCUMENTS 2,865,499 A * 12/1958 Brogren ..... B65D 81/075 206/386
2,865,500 A * 12/1958 Parsons ..... B65D 19/06 206/386
(Continued)

FOREIGN PATENT DOCUMENTS

DE 90 16 862 U1 2/1991
DE 20 2010 009806 U1 10/2010
(Continued)

*Primary Examiner* — Hemant M Desai
*Assistant Examiner* — Valentin Neacsu
(74) *Attorney, Agent, or Firm* — GE Global Patent Operation; Stephen G. Midgley

(57) ABSTRACT

A journal transport and storage device for moving, transporting and storage of a pulverizer journal assembly is provided. The device includes a base and a frame extending from the base defining a shaped configuration to support at least a portion of the pulverizer journal assembly.

9 Claims, 2 Drawing Sheets

(51) Int. Cl.
*B02C 15/00* (2006.01)
*B65D 19/44* (2006.01)
*B65D 85/68* (2006.01)

(52) U.S. Cl.
CPC ..... *B65D 2519/00532* (2013.01); *B65D 2519/00616* (2013.01); *B65D 2519/00666* (2013.01); *B65D 2519/00701* (2013.01); *B65D 2519/00786* (2013.01); *B65D 2585/6897* (2013.01)

(56) References Cited

U.S. PATENT DOCUMENTS 3,753,407 A * 8/1973 Tilseth ..... B65D 19/44 108/53.3
4,257,523 A * 3/1981 Blasio ..... B65D 19/44 108/55.3
4,481,972 A * 11/1984 Stavlo ..... B65D 19/08 108/55.1
4,579,226 A * 4/1986 Blake ..... B65D 5/5035 206/422
4,678,084 A * 7/1987 Maker ..... B65D 1/48 206/389
4,747,495 A * 5/1988 Hoss ..... B25H 1/0007 108/55.3
4,792,041 A * 12/1988 Grigsby ..... B65D 85/68 206/319
4,921,100 A 5/1990 Krause
4,938,350 A * 7/1990 Grigsby ..... B65D 85/68 206/319
5,275,279 A * 1/1994 Grigsby ..... B65D 85/68 206/319
5,507,237 A * 4/1996 Barrow ..... B65D 19/08 108/53.1
6,058,852 A * 5/2000 Estvanko ..... B65D 19/0012 108/51.11
6,231,284 B1 * 5/2001 Kordel ..... B65D 19/44 108/55.3
6,379,107 B1 * 4/2002 Iwasaki ..... B65D 19/44 108/55.3
6,679,468 B1 * 1/2004 Hsu ..... A45C 9/00 248/454
7,383,951 B2 * 6/2008 Smolenski ..... B65D 19/44 206/386
8,011,865 B2 * 9/2011 Anderson ..... B60P 7/12 410/117
2003/0183590 A1 * 10/2003 Chubb ..... B65D 19/12 211/41.14
2008/0237168 A1 * 10/2008 Harpole ..... B65D 19/12 211/195
2009/0096132 A1 * 4/2009 Yamamoto ..... H05K 7/026 264/297.7
2009/0266275 A1 * 10/2009 Feeney ..... B64F 5/0036 108/55.1
2010/0119187 A1 * 5/2010 Creelman ..... F16C 35/063 384/571
2011/0097186 A1 * 4/2011 Gibson ..... B65D 85/48 414/800
2011/0132239 A1 * 6/2011 Poulsen ..... B65D 19/0095 108/55.1
2011/0239460 A1 * 10/2011 Yan ..... B65D 85/68 29/888

FOREIGN PATENT DOCUMENTS

FR 2 654 418 A1 5/1991
WO 2005/056392 A2 6/2005

* cited by examiner

DEVICE AND METHOD FOR TRANSPORT AND STORAGE

TECHNICAL FIELD

The present disclosure relates to a transport and storage device for a mechanical device, and, more particularly, to transport and storage device for a pulverizer or a pulverizer journal assembly.

TECHNICAL BACKGROUND

Typically, pulverizers or parts thereof, such as journal assemblies, need to be disassembled in order to be easily shipped to manufacturing facilities for maintenance activities. Once the maintenance activities are accomplished the disassembled journal assemblies are transported from the manufacturing facilities to customers' sites in the disassembled form. Once transported to customers' sites, the journal assemblies are reassembled for utilization or if not required immediately stored at the customers' sites. Additionally, assembled pulverizers and/or journal assemblies must contain or be filled with oil during storage to prevent bearing corrosion.

Repetitive assembly and disassembly of pulverizers and/or pulverizer journal assemblies are quite cumbersome and time consuming processes demanding significant man hours, and consequently, significant cost. Further, assembled pulverizers and pulverizer journal assemblies containing or filled with oil require significant care at additional cost during movement, transport and/or storage.

Therefore, pulverizers and/or pulverizer journal assemblies not requiring repetitive disassembly and reassembly for movement, transportation and/or storage are needed. Likewise, pulverizers and/or pulverizer joint assemblies containing or filled with oil without oil leakage during movement, transportation and/or storage are needed.

SUMMARY

The present disclosure describes a device and a method of using the device for movement, transport and/or storage of pulverizers or parts thereof, such as journal assemblies, that reduce or eliminate the current need for pulverizer and/or pulverizer journal assembly disassembly and reassembly for movement, transport and/or storage thereof. The subject device and method likewise prevent or eliminate pulverizer and/or pulverizer journal assembly oil leakage associated such movement, transport and/or storage. As such, the subject device and method reduce costs associated with pulverizer or pulverizer journal assembly movement, transportation and/or storage. For purposes of clarity and simplicity the pulverizer or pulverizer parts, such as a journal assembly, are hereinafter referred to simply as the "journal assembly". The subject device and method are convenient to use, effective in reducing or eliminating repetitive disassembly and reassembly for movement, transportation and/or storage of the journal assembly, and effective in avoiding oil leakage from the journal assembly during movement, transport and/or storage.

In summary, the subject device and method provide for support and protection of the journal assembly during movement, transport and/or storage to prevent damage thereto. Specifically, the subject device and method are useful for movement, transport and/or storage of a journal assembly comprising a journal assembly shaft, a trunnion shaft and a journal opening cover assembled to form a single unit that contains or is filled with a fluid such as oil to prevent bearing corrosion.

The subject device includes a base structure, a frame structure extending on the base structure to define a shaped configuration accommodative to support at least a portion of the journal assembly with the journal assembly shaft supported with a particular orientation on the base structure. The device further includes a plurality of first and second resting members extending aligned and spaced from the frame structure to support the journal assembly. Specifically, the plurality of first resting members and frame structure in combination support the journal opening cover, and the plurality of second resting members supports the trunnion shaft. Additional features and advantages of the subject device will be apparent from the following description and claims.

The subject method includes arranging a journal assembly within a device formed by a base structure, a frame structure extending on the base structure to define a shaped configuration accommodative to support at least a portion of the journal assembly with the journal assembly shaft supported in a particular orientation on the base structure, and a plurality of first and second resting members extending aligned and spaced from the frame structure to support the journal assembly, supporting the journal assembly within the device and supporting the journal assembly shaft in an oil-leakage preventive orientation within the device for stable movement, transport and storage thereof. Further, in accordance with this method, using the plurality of first resting members and frame structure in combination to support the journal opening cover, and using the plurality of second resting members to support the trunnion shaft enables stable movement, transport and storage thereof. Additional features and advantages of the subject method will be apparent from the following description and claims.

BRIEF DESCRIPTION OF THE DRAWINGS

The advantages and features of the subject device is further described in more detail with reference to the accompanying drawings, wherein like features are identified with like reference numerals, and in which.

DETAILED DESCRIPTION

Figure 1:
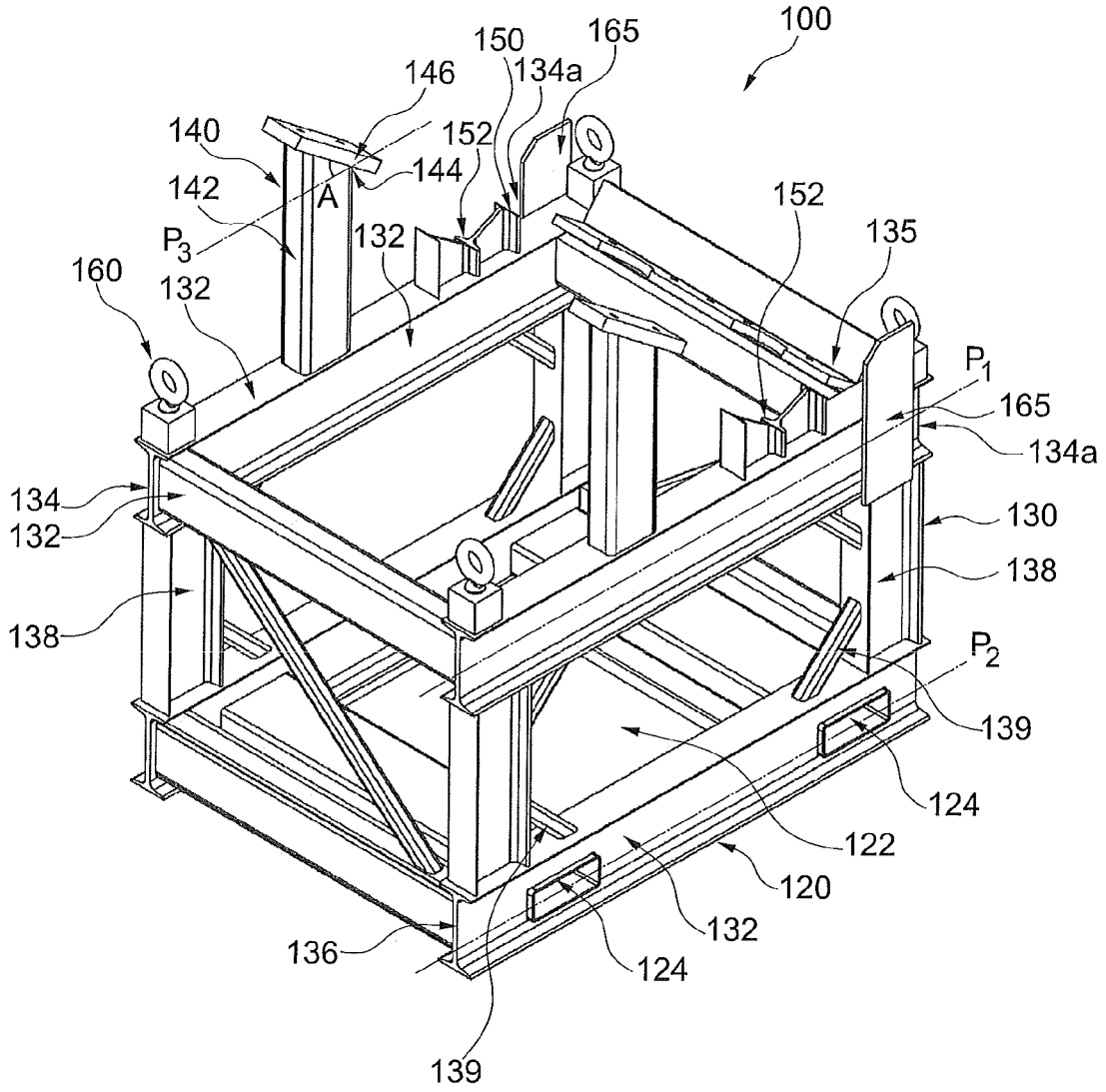
FIG. 1 is a perspective side view of a transport and storage device in accordance with an exemplary embodiment of the present disclosure.
Figures 2A, 2B, 2C:
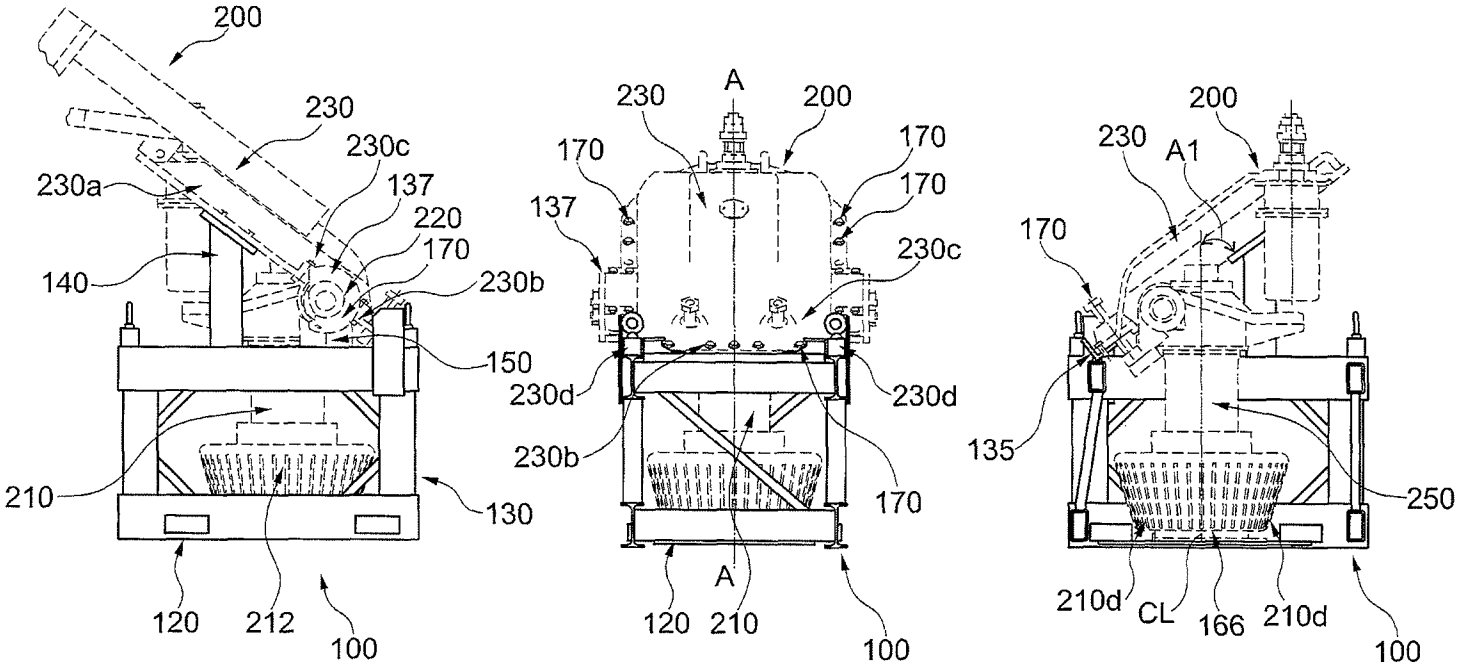
FIG. 2A is a side view of the device and at least a portion of a journal assembly arranged therein for movement, transport and/or storage.
FIG. 2B is a back view of the device and at least a portion of a journal assembly arranged therein for movement, transport and/or storage.
FIG. 2C is a cross sectional view of the device and at least a portion of a journal assembly arranged therein for movement, transport and/or storage taken along A-A of FIG. 2B.

FIGS. 1 through 2A-C illustrate an example of the subject transport and storage device 100 (herein after referred to as 'device 100'). The device 100 is useful for movement, transport and/or storage of a pulverizer or pulverizer parts, such as a journal assembly 200. As noted previously herein, for purposes of clarity and simplicity the pulverizer or pulverizer parts, such as a journal assembly, are hereinafter referred to simply as the "journal assembly" 200. The journal assembly 200, may be conveniently and economically moved, transported and/or stored utilizing the device 100. As such, the subject journal assembly 200 suitable for movement, transport and/or storage using device 100 includes a journal assembly shaft 210, a trunnion shaft 220 and a journal opening cover 230, each assembled together to form a single unit.

The subject device 100 useful for movement, transport and/or storage of journal assembly 200 includes a base structure 120 (may also be referred to as base 120) and a frame structure 130 (may also be referred to as frame 130) extending from the base 120 to define a shaped configuration supportive of at least a portion of the assembled journal assembly 200.

In accordance to one embodiment of the present disclosure, the base 120 includes a base plate 122 and a pair of spaced apart support channels 124 disposed on the base plate 122. In one embodiment of the present disclosure, the base 120 may be fabricated from carbon steel to provide adequate support and strength during movement, transport and/or storage of the journal assembly 200. However, without departing for the scope of the present disclosure base 120 may be made from any other material of adequate strength and durability for the intended weight to be carried thereby and duration of use, as known in the art.

Further, the frame 130 includes a plurality of horizontal frame members 132 and a plurality of vertical frame members 138. The plurality of horizontal and vertical frame members 132, 138 may be fabricated from carbon steel bars to provide adequate support and strength to the frame 130 for the intended weight carried thereby and duration of use. However, the plurality of horizontal and vertical frame members 132, 138 may likewise be made from any other material of adequate strength and durability for the intended weight to be carried thereby and duration of use, as known in the art.

One set of the plurality of horizontal frame members 132 are arranged horizontally to form an upper horizontal frame support 134. Similarly, another set of the plurality of horizontal members 132 are arranged horizontally to form a lower horizontal frame support 136. Such upper and lower frame supports 134, 136 are arranged in horizontal parallel planes P1, P2, respectively, one above the other in a spaced relationship with respect to each other. Between upper and lower frame supports 134, 136, the plurality of vertical frame members 138 are arranged and coupled thereto to form frame 130. The vertical frame members 138 may be coupled to the upper and lower horizontal frame supports 134, 136 through welding, riveting, nut-bolt coupling, and the like. However, such coupling may likewise be enabled utilizing any other means suitable for the subject weight and purpose, as known in the art. In one embodiment, supporting brackets 139 are utilized for increased support to strengthen the overall frame 130.

The frame 130 formed by the plurality of horizontal and vertical frame members 132, 138 is of a shape supportive of the journal assembly 200 or at least the portion thereof. The frame 130 may be square, rectangular, parallelogram, quadrangle and of any other similarly shaped structure supportive of the journal assembly 200 or at least the portion thereof for stable movement, transport and/or storage use. In another exemplary embodiment, the frame 130 may be unitarily formed by a suitable technique, such as molding, casting, or the like, to form a supportive shaped structure such as that disclosed above, to support the journal assembly 200 during movement, transport and/or storage. Suitable materials for such unitarily formed frame 130 include for example carbon steel and like materials adequate in strength and durability for the intended weight to be carried thereby and duration of use, as known in the art The device 100 further includes a plurality of first 140 and second 150 resting members arranged to extend from the frame 130 to support the journal assembly 200 in the device 100 during movement, transport and/or storage thereof. The plurality of first resting members 140 extend from the upper horizontal frame support 134. In one embodiment, the plurality of first resting members 140 may be vertical bars 142. Each of the vertical bars 142 include a free end 144 with an angled supporting projection 146 disposed thereon. In an exemplary embodiment, supporting projection 146 may be angled at approximately 45 degrees to approximately 55 degrees from a horizontal line P3 to be capable of supporting the journal assembly.

Further, the plurality of second resting members 150, are arranged to extend from the upper horizontal frame support 134. In one embodiment, each of the second resting members 150 include brackets 152.

The plurality of first and second resting members 140, 150 are arranged on the upper horizontal frame support 134, wherein the first resting members 140 are of a length L1 greater than the length L2 of the second resting members 150. The length L1 and L2 may vary depending upon specific journal assembly configurations.

The device 100 may also further include a plurality of lifting attachments 160 coupled to the frame 130 for moving the device 100. In one embodiment, the lifting attachments 160 are provided on or secured to the upper horizontal frame support 134. Alternatively, lifting attachments 160 may be arranged at any desired locations over the frame 130 adequate for the intended weight carried thereby, for the duration of use thereof and for the stable lifting and other moving of the device 100.

Referring now specifically to FIG. 2A to 2C, assembled journal assembly 200 may be stably positioned within the device 100 using an overhead crane or like equipment. As such, the journal opening cover 230 is positioned at an angle A1 of about 45° to about 55° from a centerline CL of a flange surface of the journal opening cover 230 and the journal assembly shaft 210. The journal assembly 200 is thereby supported by the first and second resting members 140, 150 of the device 100. More specifically, the first resting members 140 support a top elevated portion 230 *a* of the journal opening cover 230 while the second resting member 150 supports the trunnion shaft 220. The angle A1 of the elevated journal opening cover 230 may be approximately 53° to ensure the journal opening cover 230 is aligned and secured with the first resting member 140 and that the trunnion shaft 220 is aligned and secured with the second resting member 150. In order to protect the trunnion shaft 220 during movement, transport and/or storage of device 100, two journal trunnion shaft end cap covers 137 may optionally be placed on and used for protection of the trunnion shaft 220 during alignment and securing trunnion shaft 220 to the second resting members 150, utilizing fasteners 170.

Further, in order to support the journal assembly 200 more securely, a portion 230 *b* of an elevated bottom end 230 *c* of the journal opening cover 230 is removably attached using fasteners 170 to the frame 130. Specifically, the upper horizontal frame support 134 includes extensions 135 to removably attach the bottom end 230 *c* of journal opening cover 230 utilizing fasteners 170. A plurality of angled supports 165 are also arranged at the corners 134 *a* of the upper horizontal frame support 134. As such, the bottom edge 230 *d* of the journal opening cover 230 is supported by the plurality of angled supports 165 at the corners 134 *a* and through extensions 135 before lowering down the journal assembly 200 into device 100 for proper alignment and support thereof within device 100.

While the journal assembly 200 is removably secured within device 100, the journal assembly shaft 210 remains free and unsupported in the device 100. In order to support the journal assembly shaft 210, a plurality of wooden, plastic or like shims 166 are provided between the journal assembly shaft 210 and the base plate 122 to minimize movement of the journal assembly shaft 210 within device 100 and to relieve stress on the trunnion shaft 220.

In order to prevent corrosion of bearings (not shown) of the journal assembly shaft 210, internal areas (not shown) of journal assembly shaft 210 may be filled with and contain a fluid F, for example a corrosion preventive fluid such as oil, during movement, transport and/or storage. The journal assembly shaft 210 may be oriented and supported vertically during movement, transport and/or storage to prevent fluid leakages at seals (not shown). The device 100 supports the assembled journal assembly 200 for movement, transport and/or storage thereof with the journal assembly shaft 210 in a vertical orientation to prevent fluid leakage therefrom.

Furthermore, the pair of spaced support channels 124 provide side 210*d* support to the vertically oriented journal assembly shaft 210 to prevent leakage of fluid within a grinding roll 212 of the journal assembly shaft 210 during movement, transport and/or storage. Additionally, the pair of spaced support channels 124 may be utilized to lift the device 100 with the journal assembly 200 positioned therein. Specifically, a fork (not shown) of a fork truck (not shown) may be inserted into the support channels 124 to lift the device 100 with the journal assembly 200 therein for positioning within a transport vehicle (not shown) to transport the device 100 with the journal assembly 200 therein to a desired location. The device 100, with the journal assembly 200 therein, may be moved and/or lifted using either a fork truck or overhead cranes (not shown).

The subject method of using device 100 includes arranging a journal assembly 200 within the device 100 formed by a base 120, a frame 130 extending on the base 120 to define a shaped configuration accommodative to support at least a portion of the journal assembly 200 with the journal assembly shaft 210 supported in a particular orientation on the base 120, and a plurality of first and second resting members, 140, 150 extending aligned and spaced from the frame 130 to support the journal assembly 200, supporting the journal assembly 200 within the device 100 and supporting the journal assembly shaft 210 in a fluid-leakage preventive orientation within the device 100 for stable movement, transport and storage thereof. Further, in accordance with this method, using the plurality of first resting members 140 and frame 130 in combination to support the journal opening cover 230, and using the plurality of second resting members 150 to support the trunnion shaft 220 enables stable movement, transport and storage thereof. The fluid-leakage preventative orientation of the journal assembly shaft 210 is preferably a vertical orientation within device 100 and end cap covers 137 may be used to protect the trunnion shaft 220. Additional features and advantages of the subject method will be apparent from the following description and claims.

The transport and storage device 100 and the method of using the same provides many significant advantages in terms of reducing effort and time required for moving, transporting and/or storing the assembled journal assembly 200 in a convenient and economical way. Hence, the subject transport and storage device 100 significantly reduces costs associated with the moving, transporting and/or storing the assembled journal assembly 200. Additionally, the journal assembly 200 is loaded directly into the device 100 without requiring repositioning. The trunnion shafts 220 are well protected during movement, transport and/or storage. The journal assembly shaft 210 is arranged in a vertical orientation when the journal assembly 200 is positioned within device 100, allowing movement, transport and/or storage of the journal assembly shaft 210 while filled with a fluid to prevent corrosion of bearings until the journal assembly 200 is installed for use. The device 100 meets all current government standards of width and height restrictions to enable transport thereof by road. Various other advantages and features of the present disclosure are apparent from the above detailed description and appendage claims.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A movement, transport and storage device for a pulverizer journal assembly having a journal assembly shaft, a trunnion shaft and a journal opening cover, comprising:

a base structure;

a frame structure extending on the base structure to define a shape configuration accommodative to support at least a portion of the journal assembly with the journal assembly shaft supported on the base structure, the frame structure including a plurality of horizontal frame members arranged forming an upper horizontal frame support and a lower horizontal frame support spaced apart from each other, and a plurality of vertical frame members arranged between the upper horizontal frame support and the lower horizontal frame support;

a plurality of first resting members extending upwardly from the upper horizontal frame support, each of the first resting members having a planar upper surface configured to receive and support a planar surface of the journal opening cover of the journal assembly; and a plurality of second resting members extending upwardly from the upper horizontal frame support, each of the second resting members being aligned with and spaced from a respective one of the first resting members, each second resting member including an upwardly and vertically facing V-shaped bracket, the plurality of second resting members being configured to support opposing ends of the trunnion shaft of the journal assembly.

2. The device of claim 1, wherein the plurality of horizontal and vertical members are carbon steel bars.

3. The device of claim 1, wherein each first resting member of the plurality of first resting members comprises:

a bar extending upwardly from the upper horizontal frame support and having a free end distal from the upper horizontal frame support; and the planar upper surface disposed on the free end of the bar.

4. The device of claim 1, wherein each of the plurality of first resting members is of greater length than that of each of the plurality of second resting members.

5. The device of claim 1, wherein the planar upper surface of each of the plurality of first resting members is angled at about 45° to about 55° from a horizontal surface of at least one of the horizontal frame members.

6. The device of claim 1, wherein the base comprises:

a base plate to support the journal assembly shaft; and a pair of spaced support channels disposed on the base plate to provide side support for the journal assembly shaft arranged vertically on the base plate to prevent leakage of fluid therefrom.

7. The device of claim 1 further comprising a plurality of lifting attachments on the frame for movement, transport or storage of the device.

8. A movement, transport and storage device for a pulverizer journal assembly, comprising:

a base structure;

a frame structure extending on the base structure and including a plurality of horizontal frame members defining an upper horizontal frame support and a lower horizontal frame support spaced apart from each other, and a plurality of vertical frame members arranged between the spaced upper and lower horizontal frame supports;

a plurality of first resting members extending upwardly from the upper horizontal frame support, each of the first resting members having a planar upper resting surface;

a plurality of second resting members extending upwardly from the frame structure and aligned with and spaced from the first resting members, each of the second resting members including an upwardly and vertically facing V-shaped bracket having a V-shape forming an obtuse angle; and a pulverizer journal assembly having a journal assembly shaft, a trunnion shaft and a journal opening cover, the pulverizer journal assembly being supported by the base structure and frame structure;

wherein the planar upper resting surface of the first resting members receive and support a planar surface of the journal opening cover of the journal assembly;

wherein the plurality of second resting members receive and support the trunnion shaft of the journal assembly; and wherein the journal assembly shaft is received by the frame structure in a vertical orientation.

9. The device of claim 8, wherein:

the planar upper resting surface of each of the plurality of first resting members is angled at about 45° to about 55° from a horizontal surface of at least one of the horizontal frame members.

* * * * *